United States Patent [19]

Baker et al.

[11] 4,321,652

[45] Mar. 23, 1982

[54] LOW VOLTAGE TRANSFORMER RELAY

[75] Inventors: Leslie R. Baker, Roseville; Daniel E. Reisem, Maplewood, both of Minn.

[73] Assignee: Minnesota Mining and Manufacturing Co., St. Paul, Minn.

[21] Appl. No.: 34,381

[22] Filed: Apr. 30, 1979

[51] Int. Cl.[3] ..... H01H 51/27

[52] U.S. Cl. ..... 361/209; 335/229; 335/234

[58] Field of Search ..... 335/229, 234, 236, 304; 361/209

[56] References Cited

U.S. PATENT DOCUMENTS

| | | | |
|---|---|---|---|
| 2,895,092 | 7/1959 | Cluwen | 335/304 |
| 2,936,408 | 5/1960 | De Bennetot | 335/304 |
| 3,154,728 | 10/1964 | Bordenet | 335/236 X |
| 3,379,214 | 4/1968 | Weinberg | 335/234 X |
| 3,461,354 | 8/1969 | Bollmeier | 361/209 |
| 3,775,715 | 11/1973 | Bosch et al. | 335/234 X |
| 4,015,174 | 3/1977 | de Bennetot | 335/236 X |

*Primary Examiner*—George Harris

*Attorney, Agent, or Firm*—Cruzan Alexander; Donald M. Sell; William D. Bauer

[57] ABSTRACT

An electromagnetic device having a gap area for conducting operating flux has a source of counter flux proximate the gap for confining operating flux to the gap area.

16 Claims, 5 Drawing Figures

LOW VOLTAGE TRANSFORMER RELAY

BACKGROUND OF THE INVENTION

1. Field of the Invention

This invention relates to an electromagnetic device and specifically to a low voltage transformer relay.

2. Description of the Prior Art

Electromagnetic devices such as the magnetic remote control switch described in U.S. Pat. No. 3,461,354 to Bollmeier may be used to control high voltage, high current electrical loads by remotely located low voltage switches. This type of remote switching device is generically called a low voltage transformer relay.

One of the principle advantages of such low voltage transformer relays is the ability to control the electrical load by a multiplicity of low voltage switches located in various locations. For example, if a low voltage transformer relay is used to control a lighting load within a room, one or more low voltage switch means located within the room as well as one or more remotely located low voltage switches may be used to control the load. Such a configuration allows one to extinguish all of the lights within a building from a single remote location having a low voltage circuit to each transformer-relay.

There is a continuing need, however, to reduce the fabrication costs and improve the electrical and mechanical performance of such low voltage transformer relays.

SUMMARY OF THE INVENTION

An electromagnetic device comprising a ferromagnetic core having opposed pole faces defining a gap. A source of operating flux establishes a magnetic field in the gap. A source of counter flux is located proximate to the gap for the purpose of confining the operating flux to the gap.

DESCRIPTION OF THE PREFERRED EMBODIMENT

Figure 1:
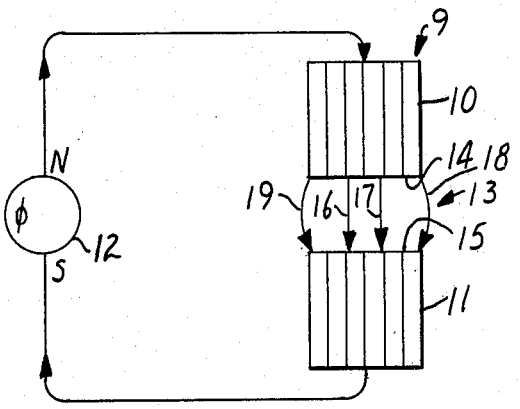
FIG. 1 is an elevation view of a portion of a prior art electromagnetic device illustrating magnetic flux in the gap.

The prior art electromagnetic device shown in FIG. 1 comprises a laminated ferromagnetic core 9 of which end sections 10 and 11 are illustrated. These core sections form a magnetic circuit with a source of operating flux 12 to generate the flux across the gap. In operation, magnetic flux flows through the magnetic circuit formed by these elements and traverses the gap 13 formed by pole faces 14 and 15. A portion of the operating flux traverses the gap as shown by flux lines 16 and 17. However, some fraction of the operating flux will pass outside the gap 13, defined by the geometric projection of the pole faces 14 and 15 and will by-pass this gap, as indicated by flux lines 18 and 19. Consequently, this by-pass flux is not available in the gap to produce efficient operation of the device.

Figure 2:
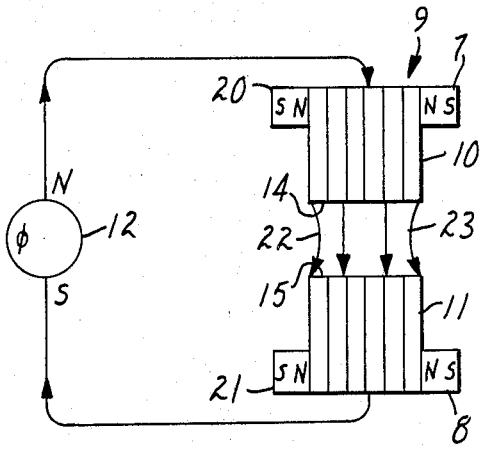
FIG. 2 is an elevation view similar to that of FIG. 1 illustrating the magnetic flux in the gap when sources of counter flux are provided proximate the gap in accordance with the present invention.

By positioning sources of counter flux 20, 21, 7 and 8 proximate the gap, as shown in FIG. 2, that fraction of operating flux which would normally leak from the gap 13 is confined to the gap area, as indicated by flux lines 22 and 23. Preferably these sources of counter flux are permanent magnets, such as Plastiform flexible magnets available from Minnesota Mining and Manufacturing Company of St. Paul, Minn. The confining effect of the sources of counter flux can be used to increase the mechanical switching force of a low voltage transformer relay, as shown in FIG. 3 by more than 50%.

Figure 3:
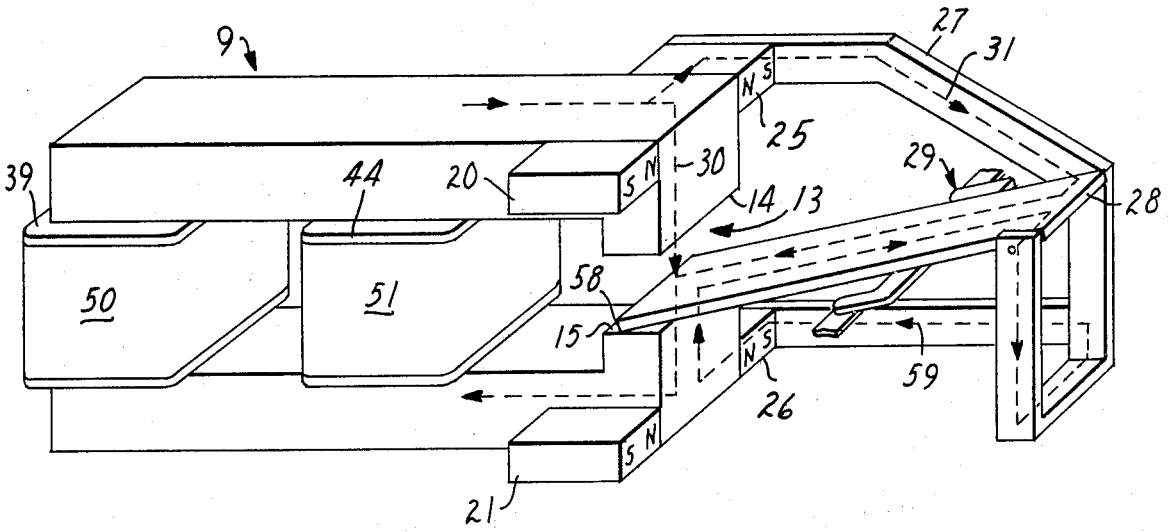
FIG.3 is an isometric view of a low voltage transformer relay constructed in accordance with the present invention, having sources of counter flux as in the FIG. 2 structure and adding thereto sources of latching flux.

The low voltage transformer relay illustrated in FIG. 3 includes a core 9, a primary winding 50, a secondary winding 51, the sources of counter flux 20 and 21, sources of latching flux 25 and 26, a flux return bracket 27 and an armature 28. The source of operating flux 12 is the primary winding 50 and the secondary winding 51. This operating flux is carried by the core 9. Sources of latching flux 25 and 26 are positioned between the ferromagnetic core 9 and the flux return bracket 27, one on either side of gap 13. Preferably the sources of latching flux are Plastiform flexible permanent magnets also. These flux sources generate magnetic flux conducted through flux return bracket 27 and armature 28 to form a magnetic circuit which will latch the armature to one of the pole faces 14 or 15. The orientation of the latching and counter flux sources is illustrated in FIG. 3. The latching magnets have like poles in contact with ferromagnetic core 9, and like poles in contact with the flux return bracket 27. In a similar fashion the counter flux magnets are oriented with the same poles against the core 9 as the latching magnets. In the quiescent state with the source of operating flux inactivated, the latching flux imparts a force sufficient to retain the armature, which actuates load switch 29, in contact with one of the pole faces 14 or 15. The path of latching flux is shown by flux line 59.

Transfer of the armature 28 from one pole face to the other is accomplished by activating the source of operating flux 12. Since the armature is attracted to the pole face that conducts the greatest net flux, transfer is initiated when flux in gap 13 exceeds the flux in the interface 58 between the armature 27 and the core 9. The main portion of the operating flux generated by the source of operating flux traverses the gap 13 and then the thin dimension of the armature 28 and finally the interface 58 between the armature and the pole face to which the armature is latched. The path of the main portion of the operating flux is shown by flux line 30. A fraction of the operating flux, shown by flux path 31 may traverse one source of latching flux and rejoin the main operating flux in the gap by circulating through flux return bracket 27 and through armature 28. The main portion of the operating flux 30 and the fractional portion 31 of the operating flux constitute the total operating flux.

During armature transfer, the total operating flux builds in the interface 58 between the armature and the pole face. This total operating flux opposes the flux generated by the latching flux sources 25 and 26. The net flux at the interface 58 is the difference between the latching flux and the total operating flux. To accomplish transfer of the armature to the opposite pole face, the total operating flux in the interface must increase until the difference between the latching flux and the total operating flux is equal to the main operating flux in the gap 13. This is in contrast to prior art low voltage transformer relays, wherein leakage flux completely by-passes the gap 13 and interface 58 and neither adds to the operating flux, which would increase the armature transfer force; nor subtracts from the latching flux, which would help overcome the latching force. In the prior art relay, operating flux in interface 58 must itself equal one-half the latching flux with no contribution from flux traversing a flux path 31. It is seen that if the operating flux through path 31 is equal to that through path 30, the operating flux through gap 13 in the relay of the present invention need only be two-thirds the prior art value for armature transfer. This reduction in operating flux in gap 13 permits larger gaps by 50% than could be used in the prior art relay.

The sources of latching flux and counter flux are positioned in the present invention and the core 9 is constructed to minimize total magnetic reluctance in the low voltage transformer relay. By shaping the source of latching flux 25 and 26 such that the source presents a large surface area A perpendicular to the flux path and a short path length L in the direction of the flux the reluctance factor L/A to operating flux can be minimized, preferably to a value less than one; $L/A<1$. By lowering the reluctance of the source of latching flux, path 31 is provided for operating flux to pass through the sources of latching flux, the flux return bracket 27 and the armature 28 thus confining flux, which in the prior art has leaked from the magnetic circuit to a magnetic circuit where it contributes to performance.

The placement of polarized sources of counter flux, which are preferably permanent magnets, in proximity to the gap acts to confine flux to the gap area. In this sense these flux sources act as magnetic insulators to increase the apparent reluctance of the gap by-pass path. This suppresses performance detracting leakage flux.

Figure 4:
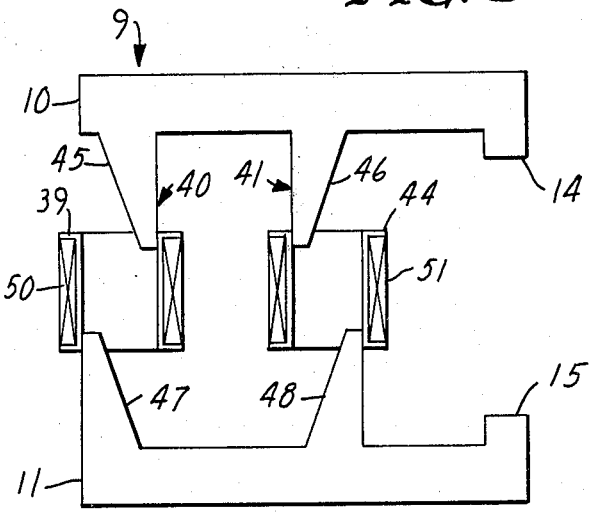
FIG. 4 is an exploded elevation view of the ferromagnetic core of the relay of FIG. 3.

To insure that the reluctance of the ferromagnetic core structure is low, a novel core structure is utilized. As shown in FIG. 4, the ferromagnetic core 9 is formed from an upper core member 10 and lower core member 11. The upper member 10 has first and second leg elements each having one tapered surface 45 and 46, respectively. Likewise, the lower member 11 has first and second leg elements, each having one tapered surface 47 and 48, respectively, complementary to the tapered surfaces 45 and 46 of upper member 10. The taper angle is preferably less than 35°. During assembly, the upper and lower core members are inserted into a spool structures 44 and 39 having hollow central portions for receiving the leg elements. The interior dimension of the hollow portions of the spool structures is smaller than the corresponding dimension of the leg elements. Insertion into the spool, therefore, forces the tapered faces 45, 46, 47, 48 into wedging contact. The first leg elements of the upper and lower core member together define a first leg 40; and the second leg elements define a second leg 41. As a consequence of the geometry of this design the flux flowing between the upper and lower core members is presented with an area much larger than the core leg cross section which reduces reluctance for a given separation between the tapered surfaces. The wedging action of the spool creates a very small clearance or interface dimension which also reduces the reluctance. The construction reduces the reluctance to one-half of the value of the prior art butt or lap joint construction.

Figure 5:
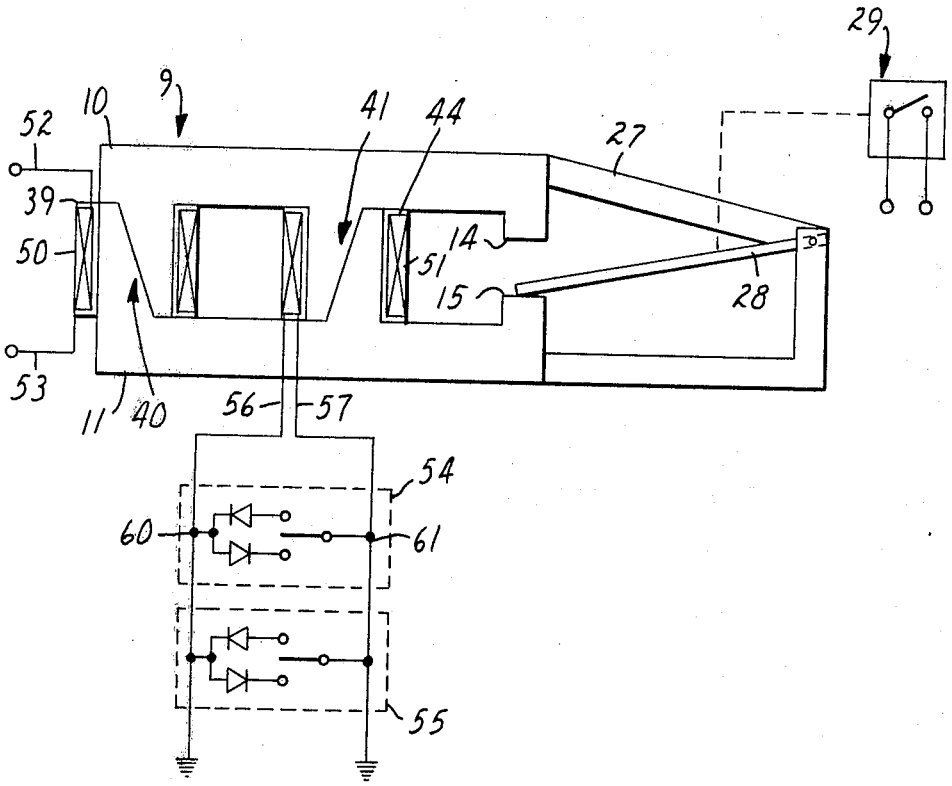
FIG. 5 is a cross-sectional elevation view of the low voltage transformer relay of FIG. 3, including electrical connections.

In FIG. 5 the electrical connections to the low voltage transformer relay are shown. A primary winding 50 and a secondary winding 51 are wound on a spool structures 44 and 39. During assembly the spools are oriented such that the secondary winding surrounds the second leg 41 of the core 9, and the primary winding surrounds the first leg 40 of the core.

In operation the primary winding 50 is connected to a source of A.C. voltage through leads 52 and 53. The A.C. voltage across the primary winding 50 induces an A.C. voltage and the secondary winding 51.

Rectifying switches 54 and 55, are connected to the secondary winding through leads 56 and 57 which permits half wave current to flow in the secondary winding opposing the primary flux and resulting in operating flux appearing in the flux paths 30, 31 of the device. The rectifying switches include single pole double throw switches of the momentary contact type, and a pair of diodes. The cathode of one diode and the anode of the other diode are connected to one terminal 60 of the switch. The other terminal 61 of the switch is connected to the secondary winding lead 57. In operation, the switch is used to selectively connect one of the diodes in series with the secondary winding. In this position, an electrical circuit is completed which allows the induced voltage in the secondary to establish an unidirectional current in the coil and a corresponding magnetic field in the core 9. This is the source of operating flux 12 to transfer the armature. The two positions of the switch correspond to the two positions of the armature. As illustrated in FIG. 5, an arbitrary number of rectifier switches 54, 55 may be connected in parallel to control the low voltage transformer relay from a number of remote locations.

The armature 28 carries a pair of electrical contacts electrically insulated from the armature which cooperate with a pair of stationary contacts to form a load switch 29. When the armature 28 contacts pole face 15 it carries the contacts thereon into contact with the stationary contacts to complete an electrical circuit to power a load. When rectifying switch 54 or 55 is momentarily moved to its off position the armature is moved to pole face 16 separating the contacts and disconnecting the power to the load.

What is claimed is:

1. An electromagnetic device comprising a ferromagnetic core having opposed pole faces defining a gap, an armature mounted for selective contact with either of said pole faces, a source of operating flux for establishing a magnetic field in said gap, a source of latching flux having a surface area A perpendicular to the flux path and a length L along the flux path such that the factor $L/A<1$, thereby providing a low reluctance path for a portion of the operating flux; for retaining said armature in contact with either of said pole faces, a flux bracket contacting said source of latching flux and contacting said armature for conducting flux therebetween, and a source of counter flux proximate said gap for confining by-pass flux to said gap.

2. The electromagnetic device of claim 1 wherein said ferromagnetic core comprises a first member having tapered first and second leg elements, a second member having tapered first and second leg elements, said tapered leg elements having continuous tapered interfaces adapted to cooperatively mate forming low reluctance first and second legs.

3. The electromagnetic device of claim 2 wherein said first leg forms the core for a primary winding, said second leg forms the core for a secondary winding, said primary winding being connected to a power source, said secondary winding being connected to rectifying switch means, said rectifying switch means connected to said secondary winding for selectivity controlling the direction of induced current in said winding for selectively establishing said operating flux.

4. The electromagnetic device of claim 3 further including a load switch means mechanically actuated by said armature.

5. An electromagnetic device comprising:

a ferromagnetic core having opposed pole faces defining a gap and having a lateral surface adjacent to said gap;

an armature mounted in said electromagnetic device capable of being positioned in either of two positions;

a source of latching flux for retaining said armature in either of said two positions;

an operating flux source for inducing operating flux in said ferromagnetic core; said operating flux for establishing a magnetic field in said gap and being capable of having said armature be selectively positioned in one of said two positions; and a source of counter flux separate from said source of latching flux, said source of counter flux positioned transverse to said operating flux and mounted on said lateral surface of said ferromagnetic core.

6. An electromagnetic device as in claim 5 wherein said source of latching flux and said source of counter flux comprise steady-state sources of flux and wherein said operating flux source comprises a variable source of flux.

7. An electromagnetic device as in claim 6 wherein said steady-state source of flux comprise permanent magnets.

8. An electromagnetic device as in claim 7 wherein said permanent magnets comprise domain size ferrite particles dispersed in a flexible nonmagnetic binder.

9. An electromagnetic device as in claim 6 wherein said variable source of flux comprises:

a primary winding wound around said ferromagnetic core and adapted to be connected to a source of alternating current power; and a secondary winding wound around said ferromagnetic core and adapted to be connected to a switch for allowing a selective unidirectional current flow.

10. An electromagnetic device as in claim 9 wherein said ferromagnetic core has a first leg and a second leg, wherein said primary winding being wound around said first leg and wherein said second winding being wound around said second leg.

11. An electromagnetic device comprising:

a ferromagnetic core having opposed pole faces defining a gap and having a lateral surface adjacent to said gap;

an armature mounted for selective contact with either of said pole faces;

a source of latching flux for retaining said armature in contact with either of said pole faces;

a source of counter flux separate from said source of latching flux, said source of counter flux positioned transverse to said operating flux and mounted on said lateral surface of said ferromagnetic core.

12. An electromagnetic device as in claim 11 wherein said source of latching flux and said source of counter flux comprise steady-state sources of flux and wherein said operating flux source comprises a variable source of flux.

13. An electromagnetic device as in claim 12 wherein said steady-state sources of flux comprise permanent magnets.

14. An electromagnetic device as in claim 13 wherein said permanent magnets comprise domain size ferrite particles dispersed in a flexible nonmagnetic binder.

15. An electromagnetic device as in claim 12 wherein variable source of flux comprises:

a primary winding wound around said ferromagnetic core and adapted to be connected to a source of alternating current power; and a secondary winding wound around said ferromagnetic core and adapted to be connected to a switch for allowing a selective unidirectional current flow.

16. An electromagnetic device as in claim 15 wherein said ferromagnetic core has a first leg and a second leg, with said primary winding being wound around said first leg and with said secondary winding being wound around said second leg.

* * * * *

UNITED STATES PATENT AND TRADEMARK OFFICE

CERTIFICATE OF CORRECTION

PATENT NO. : 4,321,652

DATED : March 23, 1982

INVENTOR(S) : Leslie R. Baker and Daniel E. Reisem

It is certified that error appears in the above—identified patent and that said Letters Patent is hereby corrected as shown below:

Column 3, Line 36, comma should be added after circuit first instance to read

"circuit, to a magnetic circuit..."

Column 4, Line 17, change "and" to --on--

"A.C. voltage on the secondary winding 51"

Column 5 of the Claims, line 21, change "selectivity" to --selectively--

Signed and Sealed this

*Twenty-second* Day of *June 1982*

[SEAL]

*Attest:*

GERALD J. MOSSINGHOFF

*Attesting Officer*

*Commissioner of Patents and Trademarks*